US008142152B2

(12) United States Patent
Drelon et al.

(10) Patent No.: US 8,142,152 B2
(45) Date of Patent: Mar. 27, 2012

(54) CONNECTION OF RADIAL ARMS TO A CIRCULAR SLEEVE VIA AXES AND SPACERS

(75) Inventors: Godefroy Francis Frederic Drelon, Saint-Etienne (FR); Sebastien Jean Laurent Prestel, Arpajon (FR); Jean-Luc Soupizon, Vaux le Penil (FR)

(73) Assignee: SNECMA, Paris (FR)

( * ) Notice: Subject to any disclaimer, the term of this patent is extended or adjusted under 35 U.S.C. 154(b) by 740 days.

(21) Appl. No.: 12/259,630

(22) Filed: Oct. 28, 2008

(65) Prior Publication Data

US 2009/0123279 A1 May 14, 2009

(30) Foreign Application Priority Data

Nov. 9, 2007 (FR) ..... 07 58941

(51) Int. Cl.
*F01D 1/00* (2006.01)
*F01D 1/02* (2006.01)

(52) U.S. Cl. ..... 415/220; 415/209.1; 415/209.3; 415/214.1

(58) Field of Classification Search ..... 415/220, 415/209.1, 209.3, 214.1
See application file for complete search history.

(56) References Cited

U.S. PATENT DOCUMENTS

| | | | | | |
|---|---|---|---|---|---|
| 3,271,949 | A | * | 9/1966 | Jones et al. | 60/791 |
| 3,843,279 | A | * | 10/1974 | Crossley et al. | 415/191 |
| 4,286,921 | A | * | 9/1981 | Donlan et al. | 415/136 |
| 4,716,721 | A | * | 1/1988 | Pask et al. | 60/796 |
| 4,890,978 | A | * | 1/1990 | McLaurin et al. | 415/209.4 |
| 5,141,394 | A | * | 8/1992 | Donlan | 415/190 |
| 5,180,282 | A | | 1/1993 | Lenhart et al. | |
| 5,292,227 | A | | 3/1994 | Czachor et al. | |
| 5,848,874 | A | * | 12/1998 | Heumann et al. | 415/189 |
| 2006/0174631 | A1 | * | 8/2006 | Parker | 60/796 |

FOREIGN PATENT DOCUMENTS

| | | | |
|---|---|---|---|
| EP | 1 149 987 | A2 | 10/2001 |
| EP | 1 482 130 | A2 | 12/2004 |
| GB | 2 272 027 | A | 5/1994 |

OTHER PUBLICATIONS

U.S. Appl. No. 12/250,768, filed Oct. 14, 2008, Drelon, et al.

* cited by examiner

*Primary Examiner* — Nitin Parekh
(74) *Attorney, Agent, or Firm* — Oblon, Spivak, McClelland, Maier & Neustadt, L.L.P.

(57) ABSTRACT

The connection assembly of an arm to a sleeve is carried out substantially by parts of axes crossing the arm and the spacers between the parts of axes and the sleeve and the assembly bolts. The assembly and the disassembly are easy, even with highly reduced encumbrance, as the connection is light and devoid of high internal efforts, and a good position precision is obtained. The assembly may be applied to stators with an exterior sleeve and, an interior hub and radial link arms, which are encountered in certain turbomachines.

9 Claims, 2 Drawing Sheets

CONNECTION OF RADIAL ARMS TO A CIRCULAR SLEEVE VIA AXES AND SPACERS

The invention relates to the connection of radial arms to a circular sleeve via axes and spacers, in particular in the turbomachines used in aeronautics.

Figure 1:
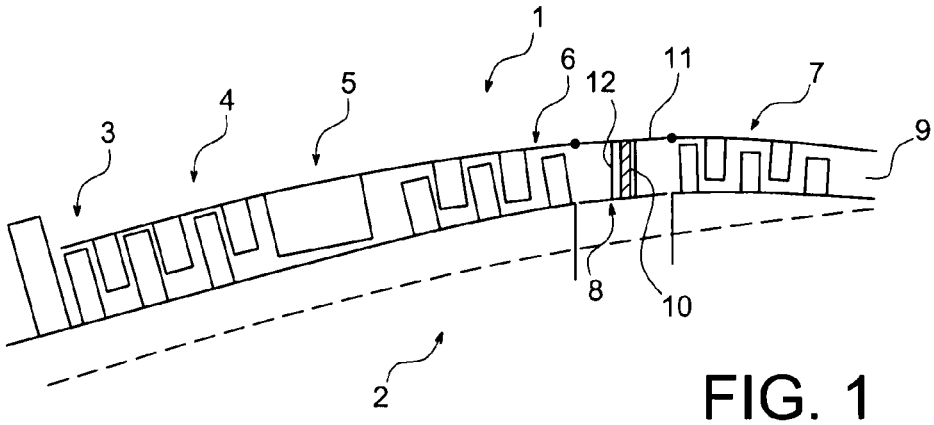
Figure 4:
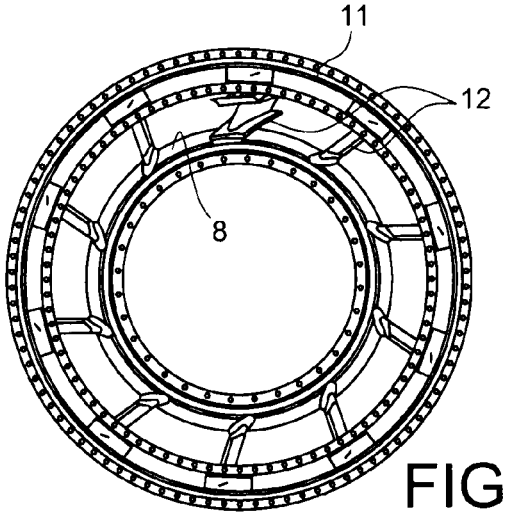

Certain arrangements of these turbomachines include a concentric exterior sleeve to a sleeve of an interior hub and joined to it via radial arms and delimiting an annular chamber or a portion of the flow of gases, it too annular but open at its axial ends. An example is shown in FIG. 1, which partially and schematically shows a turbomachine comprising conventionally, between a stator 1 and a rotor 2, successively low pressure compressors 3 and high pressure compressors 4, a combustion chamber 5, and high pressure turbines 6 and low pressure turbines 7; the rotor 2 can be divided into two separate portions between the turbines 6 and 7, and an interior hub 8 extends between these two portions in order to maintain a smooth form of a flow 9 of gases in the turbomachine. The interior hub 8 is supported by substantially radial arms 10 that join its (circular interior) sleeve to an exterior concentric sleeve 11 belonging to the stator 1 and which also delimits the flow 9 of gases, of the opposite exterior side. The arms 10 are profiles of simple section, generally rectangular. They are subjected to the high temperatures attained by the combustion gases, and influencing their flow. It is necessary to surround them with fairings 12 separated from them with sufficient spacing, in order to protect them somewhat from the heating and in order to provide a by-pass section of good aerodynamic quality to the gases. FIG. 4 shows the assembly of the exterior sleeve 11, arms 10 and of the interior hub in an isolated state, so as to provide a clearer idea of this. The assembly flanges (not referenced) on stator 1 and on rotor 2 appear here.

Difficulties appear when carrying out the assembly of the arms 10 to the exterior sleeve 11, whether the arms 10 are of one piece with the interior hub 8 or have been assembled to it beforehand, since the fairings 12, placed around the arms 10, leave only a small amount of clearance until the exterior sleeve 11.

The docking movement of the arms 10 to the assembly locations of the exterior sleeve 11 is therefore delicate to carry out, as is likewise the introduction of the tools needed for the assembly through the space of the fairings 12. The connection between the arms 10 and the exterior sleeve 11 must be designed in order to satisfy these constraints, but also to resist the major effort that is exerted on the arms during service and the major heating that they undergo despite the fairings 12.

Figure 2:
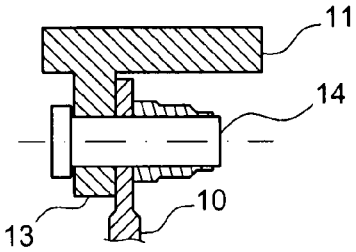

A conventional assembly, shown in FIG. 2, consists in carrying out a piercing at the end of each arm 10, in establishing a lug 13 pierced on the exterior sleeve 11, in placing the arm 10 against the lug 13 in such a way as to align its piercing with the piercing of the lug, and in passing a bolt 14 through the alignment of the piercings and which also serves as a support axis; but the efforts undergone by the arm 10 subject the parts of the assembly to greater efforts caused by the protuberance of the assembly, and in particular the bolt is loaded with bending, which is disadvantageous and obliges to correctly oversize the parts of the connection, so as to resist the greater bending constraints than in the case of a symmetric configuration with two lugs. That is why, in another design, shown in FIG. 3, the exterior sleeve 11 is provided with two parallel lugs 15 and 16 between which the end of the arm 10 is placed and a bolt 17 is mounted by passing through the piercings of the arm 10 and of the two lugs 15 and 16. The bending efforts are then reduced, and the connection can be built more lightly, but a dilemma then appears: if the lugs 15 and 16 are separated (which may be required by an assembly which needs an approach of the arm 10 in a direction that is not parallel to the faces of lugs 15 and 16) the assembly is easy but the bolt 17 is subjected to shearing, and substantial bending (even if the bending is not as substantial thanks to the symmetry of the configuration) and the assembly has some play; and bringing the lugs 15 and 16 closer to one another, during assembly, by tightening the bolt 17, is not advantageous because the internal constraints become excessive and the bolt 17 will grip more easily; if on the contrary the lugs 15 and 16 are built close in relation to one another, the play with the end of the arm 10 becomes low or even null and the bending of the bolt 17 disappears, but it becomes difficult to introduce the arms 10 between the lugs 15 and 16, and even impossible if the arms 10 are orientated with an inclination in the angular direction of the machine, which is highly frequent after the correction of the flow of gases that they must exert, because the assembly must then be carried out according to a screw motion which does not make it possible to exert the efforts needed for the introduction.

Other designs of a connection between the arms and the exterior sleeve make use of intermediate pieces, assembled to the sleeve as well as to the arms. An example is in U.S. Pat. No. 5,272,869. They often have the disadvantages of having excessive dimensions in order to allow for easy assembly and are generally bolted to the arms, with the risk of making disassembly of the arms impossible if the bolts grip.

This latter disadvantage subsists in other connections, wherein the arms are connected directly to the sleeve by bolts crossing the latter and oriented parallel to the direction of the arms. An example is in U.S. Pat. No. 6,439,841. The screws may be engaged in set threaded inserts in the piercings of the arm, or engaged with the play in the smooth piercings of the arm which emerge onto openings wherein the nuts of the bolts can be introduced and screwed.

The advantages obtained by the invention in relation to these various designs can be explained as such: the assembly of the connection is easy, even with the reduced accesses for which the fairing is responsible; the parts of the connection are simple, of low volume and are lightweight; additional efforts due to protuberances or to deformations during assembly are avoided; the bolts are disjointed from the arm, in contact with cooler parts, and therefore less subject to heating and grippings; and the precise positioning of the arms on the sleeve is guaranteed.

In a general form, the invention relates to an arrangement comprising a circular sleeve, substantially radial arms joining the sleeve to another concentric sleeve, and connections of the arms to the sleeve or to the interior hub, the connections each comprising at least one piercing crossing the arm in parallel to the sleeve, an axis crossing each of said piercings, characterised in that the axis is provided with a pair of piercings on either side of the arm, and the connections further comprise a pair of spacers arranged on either side of the arm between the axis and the sleeve, piercings crossing the sleeve and the spacers and forming alignments with the piercings of the axis, and bolts crossing the alignments of the piercings and hugging the sleeve, the axis and the spacers.

In terms of the invention, the sleeve connected to the arm as indicated can be the exterior sleeve 11, as is usual, but also the circular sleeve of the interior hub 8: the arrangement would be the same except for a few dimensional modifications.

In a preferred embodiment, the arrangement further comprises a pair of axes for each of the connections, the axes of the pair being parallel, and four alignments of the aforementioned piercings and of the aforementioned bolts.

In another embodiment, the arrangement comprises positioning pins in other alignments of piercing that extend in the arm, and either in the sleeve or in the axis or the axes.

Another aspect of the invention is a turbomachine comprising the connection arrangement detailed hereinabove.

Figure 3:
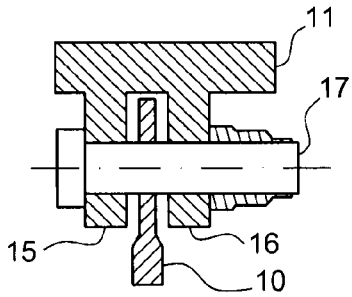

The invention shall now be described in reference to the following figures:

FIG. 1 already described shows a turbomachine equipped with the invention;

FIGS. 2 and 3 already described show two embodiments or assemblies that are known in the art;

FIG. 4, already described, shows a full view of the sleeve and of the arms once assembled;

and FIGS. 5, 6, 7, 8 and 9 show the invention more precisely.

Figure 5:
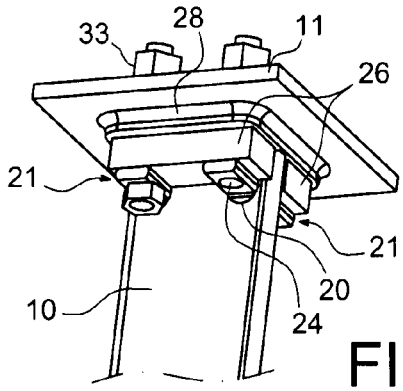
Figure 6:
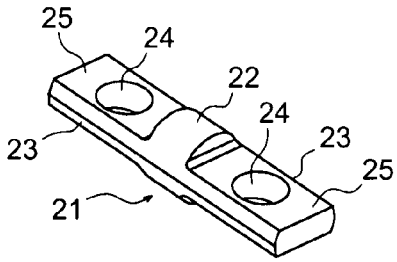
Figure 7:
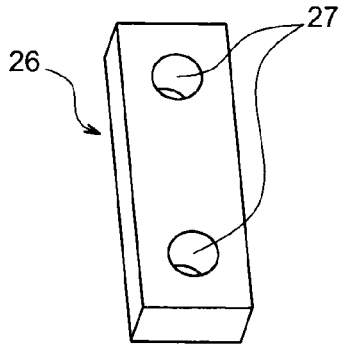

The assembly is shown in FIG. 5, and its elements in FIGS. 6, 7, 8 and 9.

Figure 8:
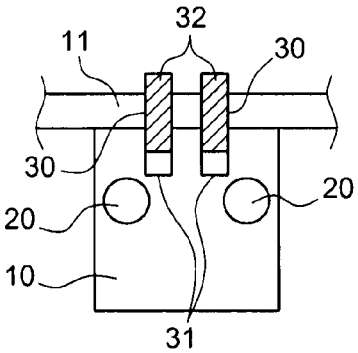
Figure 9:
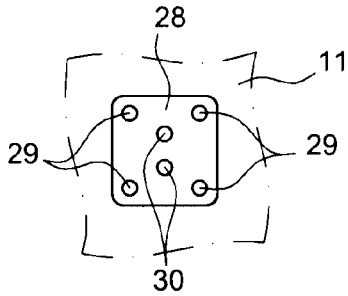

The end of the arm 10 carries two parallel piercings 20, established at its end through the smallest dimension and two opposite sides (FIGS. 5 and 8). Axes 21 (FIGS. 5 and 6) are engaged through piercings 20 and go beyond this. They include a central portion 22 having the same section—more preferably circular—a the piercings 20 and housed in them and two lateral portions 23 protruding from the arm 10 and each crossed by a piercing of axis 24. The lateral portions 23 are provided with flat surfaces 25. The arrangement further comprises spacers 26 (FIGS. 5 and 7), crossed by a pair of spacer piercings 27 that are parallel in relation to one another.

The exterior sleeve 11 is provided with a boss 28 (FIGS. 5 and 9) associated with each of the connections and of which the surface is planar or cylindrical, the cylinder admitting the same axis as the turbomachine. It is crossed by piercings, of which four exterior piercings 29 and two interior piercings 30, through each boss 28.

The assembly is carried out by mounting the fairings 12 (which are not shown in the latter figures) around the arms 10 and by introducing the assembly composed of the interior hub 8, arms 10 and fairings 12 into the exterior sleeve 11 with an axial movement. The positioning is carried out when the interior piercings 30 come as an extension of piercings 31 established in the ends of the arm 10 (FIG. 8). Positioning pins 32 can then be introduced into these piercing alignments 30 and 31 in order to maintain the arms 10 at a precise and fixed position. The axes 21 are then introduced into the piercings 20. The spacers 26 are then introduced between the bosses 28 and the flat surfaces 25 of the axes 21 on either side of the arm 10, each one of the spacers 26 under one of the protruding portions 23 of each of the axes 21. When the position is adjusted, four alignments have been carried out, each comprising an exterior piercing 29 of the sleeve 11, a spacer piercing 27 and an axis piercing 24. Bolts 33 are finally threaded through these piercing alignments and tightened in such a way as to compress the spacers 26 between the axes 21 and the exterior sleeve 11. Alternatively, positioning pins analogous to 32 could extend until within another piercing of the axis 21 in order to retain the latter in place.

The symmetric nature of the assembly reduces the efforts applied, and especially on the arms 10. All of the parts of the connection are placed not far from the exterior sleeve 11, which makes it possible to mount them or adjust them without difficulty via the spacing present between the exterior sleeve 11 and the fairing 12. The bolts 32 can be accessed easily and can be mounted as desired with the nut inside or outside the exterior sleeve 11, according to encumbrance or other constraints that can be encountered. Bolts 32 are disjointed from the arms 10, in such a way that the disassembly of the connections should remain possible even in the event of complications, such as nut grippings. The axes 21 can be reduced to a single one by accepting a slightly poorer distribution of the efforts. The sections of the central portion 22 and the piercings 20 can be non circular, although a circular form is preferred since it is easier to manufacture while still allowing for a more regular and better defined distribution of the efforts.

The invention claimed is:

1. An arrangement comprising:

a first circular sleeve;

substantially radial arms joining the first sleeve to a second concentric sleeve; and connections of the arms to the first sleeve, the connections each comprising at least one piercing crossing the arm in parallel to the first sleeve, an axis crossing each of said piercings, wherein the axis is provided with a pair of piercings on either side of the arm, and wherein the connections further comprise a pair of spacers arranged on either side of the arm between the axis and the first sleeve, piercings crossing the first sleeve and the spacers and forming alignments with the pair of piercings of the axis, and bolts crossing the alignments of the pair of piercings of the axis, the piercings of the first sleeve, and the piercings of the spacers, and hugging the first sleeve, the axis and the spacers.

2. The arrangement set forth in claim 1, further comprising a pair of axes for each of the connections, the axes of the pair being parallel, and four alignments of the aforementioned piercings and aforementioned bolts.

3. The arrangement as set forth in claim 1, wherein the piercing of the arm and a central portion of the axis, engaged in the arm piercing, are of circular section.

4. The arrangement as set forth in claim 1, further comprising pins for positioning in other piercing alignments, which extend in the arm and the first sleeve.

5. The arrangement as set forth in claim 1, further comprising positioning pins in other piercing alignments, which extend in the arms and the first sleeve and the axis.

6. The arrangement as set forth in claim 1, wherein the first sleeve, which is substantially conical, comprises bosses with a planar or cylindrical interior surface, the sleeve piercings crossing the bosses and the spacers resting on the planar or cylindrical interior surface.

7. A turbomachine comprising an arrangement in accordance with claim 1.

8. The turbomachine set forth in claim 7, wherein the arms are surrounded with fairings.

9. The turbomachine as set forth in claim 7, wherein the first sleeve, an interior hub, which is the second sleeve, and the arms are present between a high-pressure turbine and a low-pressure turbine, the arms crossing a flow of combustion gases.

* * * * *